US008015715B2

(12) United States Patent
Perkins

(10) Patent No.: US 8,015,715 B2
(45) Date of Patent: Sep. 13, 2011

(54) LOG FLATTENING CHAIN SAW ARRANGEMENT

(76) Inventor: Robert L. Perkins, Newfield, ME (US)

( * ) Notice: Subject to any disclaimer, the term of this patent is extended or adjusted under 35 U.S.C. 154(b) by 513 days.

(21) Appl. No.: 11/975,068

(22) Filed: Oct. 17, 2007

(65) Prior Publication Data

US 2009/0100977 A1 Apr. 23, 2009

(51) Int. Cl.
*B27B 17/00* (2006.01)

(52) U.S. Cl. ..... 30/371; 30/377; 30/382; 83/745; 83/834

(58) Field of Classification Search ..... 30/371, 30/376–378, 381–387; 83/745, 820, 833, 83/834, 850

See application file for complete search history.

(56) References Cited

U.S. PATENT DOCUMENTS 3,092,156 A * 6/1963 Hayden ..... 30/371
3,931,676 A * 1/1976 Merle ..... 30/371
4,388,762 A * 6/1983 Debell et al. ..... 33/630
4,726,274 A * 2/1988 Pitoni et al. ..... 83/745
4,833,781 A * 5/1989 Allen ..... 30/377
5,156,156 A * 10/1992 Ruzich ..... 30/382
D341,309 S * 11/1993 Hammond ..... D8/70
5,438,065 A * 8/1995 Uneme et al. ..... 514/353
5,511,315 A * 4/1996 Raya ..... 30/371
5,568,758 A * 10/1996 Moore ..... 83/745
5,713,134 A * 2/1998 Stevens ..... 30/376
5,878,800 A * 3/1999 Young ..... 144/372
6,021,826 A * 2/2000 Daniell ..... 144/73
6,038,775 A * 3/2000 Holladay ..... 30/376

* cited by examiner

*Primary Examiner* — Laura M. Lee
(74) *Attorney, Agent, or Firm* — Don Halgren

(57) ABSTRACT

A chain saw arrangement for cutting flat sides or kerfs on a round log or timber. The arrangement includes a chain saw housing at a first end of the chain saw. An elongated chain/blade supporting frame extends from the chain saw housing. A multi-tooth chain/blade is movably supported from the elongated frame. A support bracket is secured to one side of the elongated frame for providing restricted support of the chain/blade on a log or timber during cutting of a transverse kerf thereon.

8 Claims, 5 Drawing Sheets

10A
52
32
12
26
44
50
48
10
46
54
52
60
18
16
"L"
32

LOG FLATTENING CHAIN SAW ARRANGEMENT

BACKGROUND OF THE INVENTION

1. Field of the Invention

The present invention relates to chain saws and more particularly to attachments to and modifications of chain saws to permit efficient kerf cutting by the chain saw.

2. Prior Art

In the timber and logging industry, it may be often desirable to flatten one or more sides of a log at a distant camp or construction site. Such flattened sides of log would be utilized to lay one log on top of another for building a wall or a fence, a cabin or the like. Typically such flat sides of a log would be accomplished by pushing the log longitudinally through a rotating or reciprocating saw blade. Movement and control of the log relative to the blade, is difficult to maneuver and is quite hazardous.

Further, if one were to push to flatten one or more sides of a log of a tree which was felled, one might not always have on hand the appropriate rotating or reciprocating saw blade as might be found in a wood working shop or a saw mill.

It is thus an object of the present invention to overcome the disadvantages of the prior art.

It is still a further object of the present invention to provide an adaptive arrangement for chain saws which can be utilized to easily and readily and safely put flat sides on round logs of felled trees.

It is still yet a further object of the present invention to obviate the need of circular or reciprocating saws as might be utilized in a saw mill to place flattened edges or notches on the side of round logs so as to cut a curve or a flattened side thereon.

BRIEF SUMMARY OF THE INVENTION

The present invention relates to an adjustable adaptor plate for utilization with a chain saw to permit that chain saw to be utilized in cutting a notch, a kerf or making flattened side or sides of a round(ish) log, in the manufacture of a beam or timber to be utilized for construction from that log.

Such a chain saw arrangement consists of a power drive at a first end of the elongated chain saw. The power drive includes a motor within a housing, and a manipulable handle attached to the upper outer side of that housing. An elongated, rigid, thin metal frame extends distally from an end of the chain saw housing. The elongated frame, rigidly attached thereto, supports a movable chain with saw teeth thereon. The chain (and saw teeth) are run on a guide track on the periphery of the elongated frame. The saw chain with the plurality of spaced-apart saw teeth thereon are controllably advanceable around the periphery of the elongated frame, and are driven by empowerment means within the housing of the power drive.

An elongated adjustable guide bracket of the present invention, is adjustably secured through a plurality of securement members, to at least one side of the elongated frame. The guide bracket is preferably of generally "L"-shape, in cross section. The guide bracket has a first side which is parallel to the plane of the elongated frame. The guide bracket has a second side which is perpendicular to its first side, and is normal to the plane of the elongated frame. The first side of the guide bracket may have a plurality of elongated slots therethrough to permit the securement means to adjustably lock the guide bracket to the elongated frame in any of a number of desired settings.

The intersection of the first side and the second side of the guide bracket has an elongated "relief cut" extending therealong, on the junction of those two sides. The relief cut permits the saw teeth clearance to move along the periphery of the elongated frame without interference of the guide bracket.

In use of the empowered chain saw with the kerf cutting attachment thereon, the second side of the guide bracket is positioned so as to permit the lower (outermost) side of the saw teeth to engage the surface of the log/timber being flattened or notched, without that lowermost side of the guide bracket hitting the outer peripheral surface of the log being cut.

The guide bracket permits the chain saw to be held in a transverse manner with respect to the longitudinal axis of the log/timber being trimmed, while the saw tooth blades and the elongated frame are moved along the longitudinal axis of the log being cut as the chain saw is held transversely with respect thereto. Thus, the sides of the saw teeth as well as the peripheral portion thereof effect the cutting operation on the log.

The elongated frame, in a further embodiment of the present invention, is wide enough, with a deep peripheral blade-riding track, to function as the "side extension" by itself. The wider frame has its track-defining "shoulder" or side edge riding on the log/beam so as to not need the "L" shaped guide bracket, but to function as that guide bracket while also supporting the saw blade as it runs in the outer track thereof.

The invention thus comprises a chain saw arrangement for cutting flat sides or kerfs on a round log or timber, comprising: a chain saw housing at a first end of the chain saw; an elongated chain/blade supporting frame extending from the chain saw housing; a multi-tooth chain/blade movably supported from the elongated frame; a support bracket secured to one side of the elongated frame for providing restricted support of the chain/blade on a log or timber during cutting of a transverse kerf thereon. The bracket may be of generally "L" shape in cross-section. The bracket may be of generally "J" shape in cross-section. The bracket preferably has a first side with a securement means therethrough for securing the bracket to the elongated frame. The bracket is preferably position-adjustable with respect to the elongated frame. The first side of the bracket has a plurality of elongated slots therethrough to permit the securement means to alter the position-adjustment of the bracket. The bracket preferably has a relief cut at an outside corner of the sides to provide clearance to the teeth on the movable blade.

The invention also includes a method of cutting a kerf in a rounded log or timber comprising one or more of the following steps: placing a chain saw on the log transversely with respect to a longitudinal axis of the log, the chain saw having an elongated blade supporting frame extending thereon; securing a support bracket to at least one side of the elongated frame; starting the chain saw; and sliding the support bracket on said log in a direction parallel to a longitudinal axis of said log, to provide stability and guidance to the blade as it cuts a kerf on the log. The method may include adjusting the bracket secured on the elongated frame so as to permit an adjustment of the depth of a cut of the kerf being made on the log. The bracket may be of generally "L" shape in cross-section. The bracket may be of generally "J" shape in cross-section.

The invention further comprises a chain saw arrangement for cutting flat sides or kerfs on a round log or timber, comprising: a chain saw housing at a first end of the chain saw, a wide elongated chain/blade supporting frame extending from the chain saw housing, a multi-tooth chain/blade movably supported on a peripheral track on the elongated frame, the wide elongated chain blade supporting frame having blade exposure-limiting shoulders to permit only a portion of a depth of the saw blade to be exposed to a timber having a kerf cut thereon. The peripheral track preferably has a depth which is greater than an exposure of the chain saw blade.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
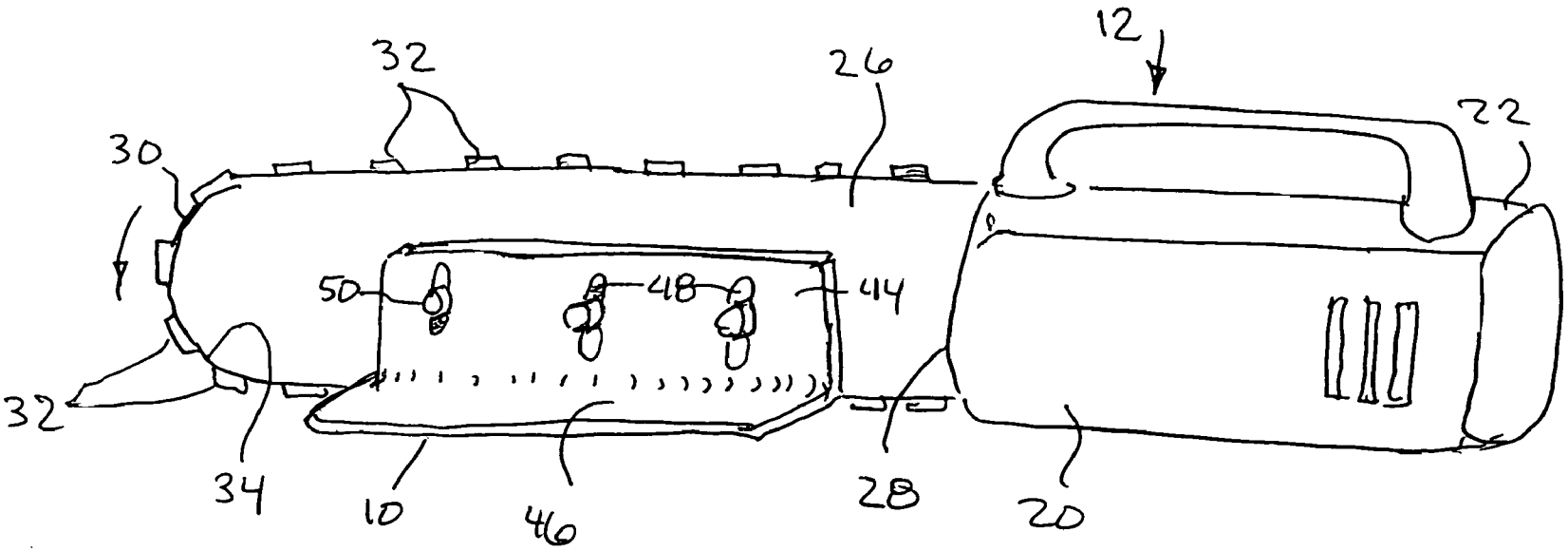
FIG. 1 is a side elevational view of a chain saw having an adjustable guide bracket attached thereon.
Figure 2:
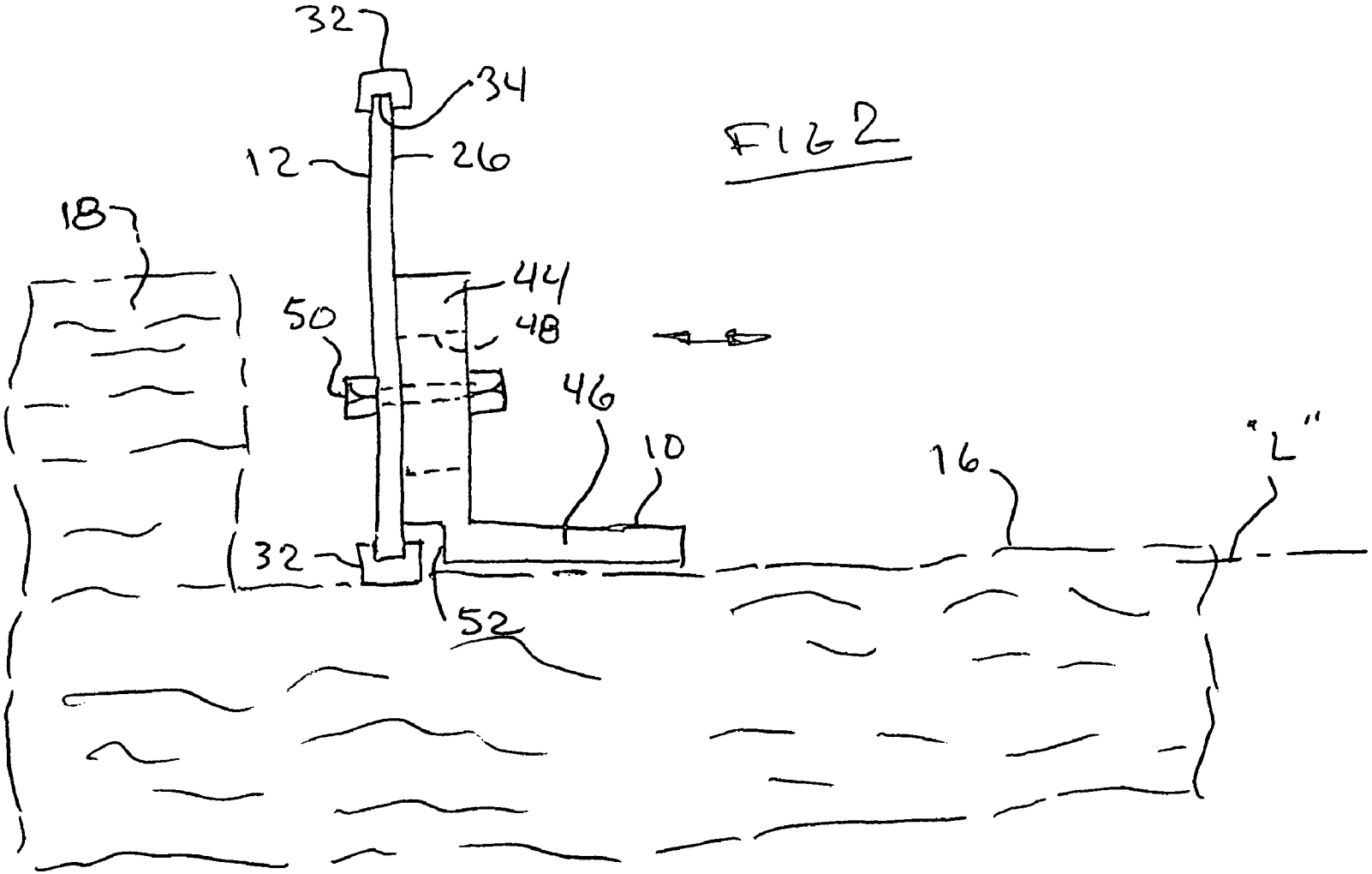
FIG. 2 is a side elevational view of a chain saw being held transversely with respect to the longitudinal axis of a log being cut, and viewing the distalmost end of the elongated frame showing the guide bracket in an edge view thereof.
Figure 3:
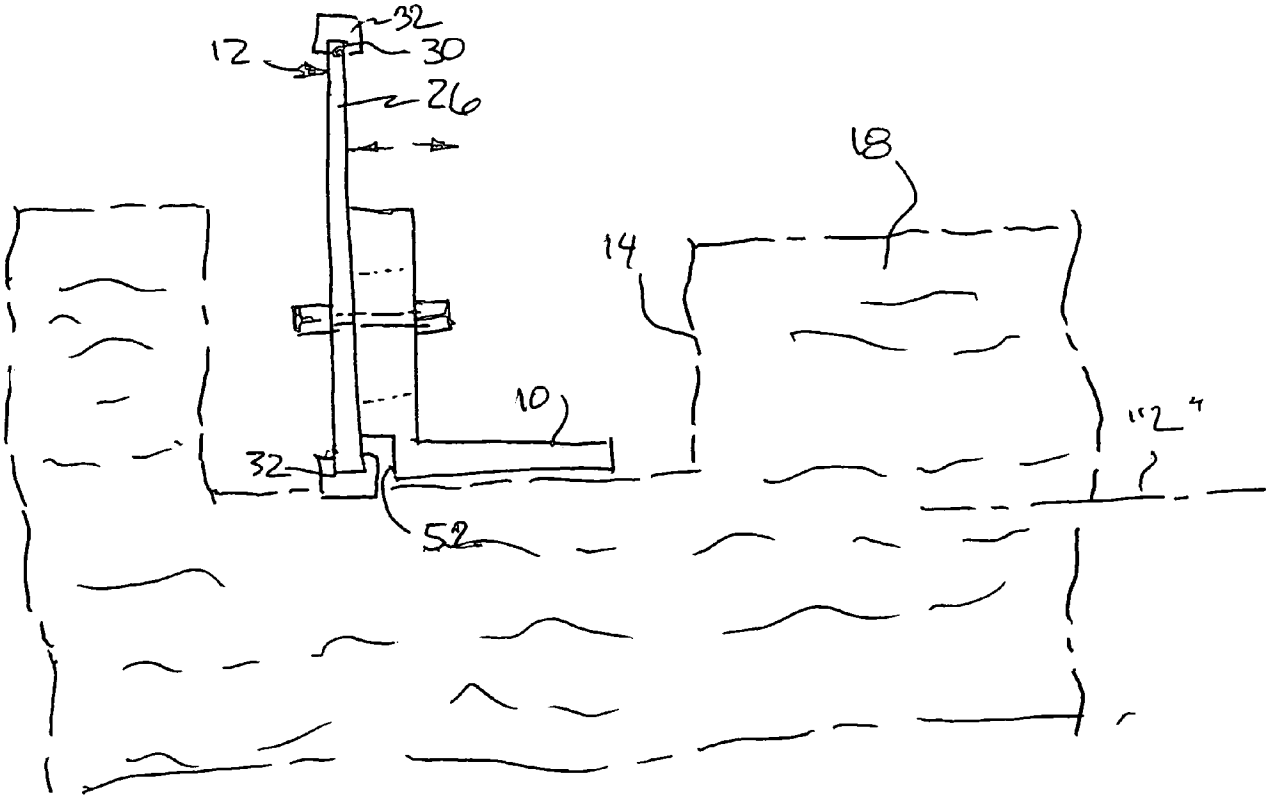
FIG. 3 is a view similar to FIG. 2, showing the end view of the chain saw and guide bracket cutting a notch or kerf and across a log being trimmed.
Figures 4, 5:
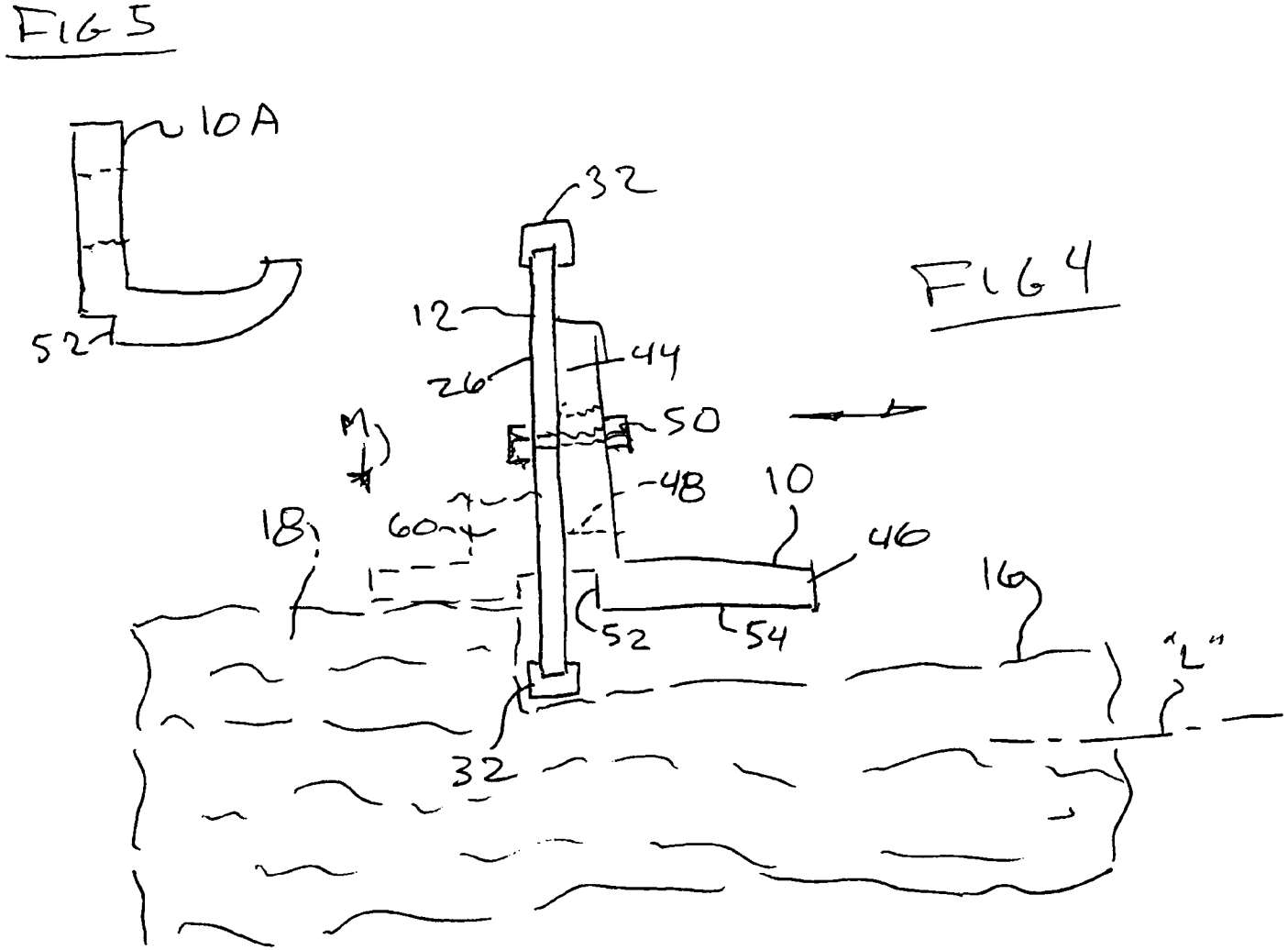
FIG. 4 is a view similar to FIGS. 2 and 3, with the adjustable guide bracket moved upwardly on the elongated frame, so as to give the teeth of the chain saw more bite in trimming the flattened side of the log.
FIG. 5 is an end view of a "J" shaped guide bracket as a further embodiment of the present invention.

Referring now to the drawings in detail, and more particularly to FIG. 1, there is shown an adjustable adaptor plate 10 for utilization with a chain saw 12 to permit that chain saw to be utilized in cutting a notch 14, a kerf or making flattened side or sides 16 of a round(ish) log or timber 18, as represented in FIGS. 2, 3 and 4, in the manufacture of a beam or timber to be utilized for construction.

Such a chain saw arrangement consists of a power drive 20 at a first end of the elongated chain saw 12, as shown in FIG. 1. The power drive 12 includes a motor, not shown, within a housing 22, and a manipulable handle 24 attached to the upper outer side of that housing 22. An elongated, rigid, thin metal frame 26 extends distally from an end 28 of the chain saw housing 22, as represented in FIG. 1. The elongated frame 26, rigidly attached thereto, supports a movable chain 30 with a plurality of saw teeth 32 thereon. The chain 30 (and saw teeth 32) are run on a guide track 34 on the periphery of the elongated frame 26. The saw chain 30 with the plurality of spaced-apart saw teeth 32 thereon are controllably advanceable around the periphery of the elongated frame, and are driven by the empowerment means within the housing 22 of the power drive 12.

The adapter plate or elongated adjustable guide bracket 10 of the present invention is adjustably secured through a plurality of securement members 50, to at least one side of the elongated frame 26, as shown in FIGS. 1-4. The guide bracket 10 is preferably of generally "L"-shape, in cross-section, as represented in FIGS. 2-4. Other embodiments of the bracket may be of "J" shape in cross-section, shown in FIG. 5, in an end view thereof. Such a "J" shape would permit a bracket 10A (and associated chain saw 12) to be more easily utilized on rougher logs/timber for surface sliding thereon.

The guide bracket 10 has a first side 44 which is parallel to the plane of the elongated frame 26, as may be seen in FIGS. 2-4. The guide bracket 10 has a second side 46 which is preferably perpendicular to its first side 44, and is normal to the plane of the elongated frame 26. The first side 44 of the guide bracket 10 may have a plurality of elongated slots 48 therethrough to permit the securement means 50 to adjustably lock the guide bracket 10 to the elongated frame 26 in any of a number of desired settings, as may be seen by the representation thereof between FIG. 2 and FIG. 4.

The intersection of the first side 44 and the second side 46 of the guide bracket 10 has an elongated "relief cut" 52 extending therealong, at the junction of those two sides 44 and 46, as may be seen in FIGS. 2-4. The relief cut 52 permits the saw teeth 32 clearance to move along the periphery of the elongated frame 26 without interference of the guide bracket 10.

In use of the empowered chain saw 12 with the kerf cutting bracket attachment 10 thereon, the second side 46 of the guide bracket 10 is preferably positioned so as to permit the lower (outermost) side of the saw teeth 32 to engage the surface of the log/timber 18 being flattened or notched, without that lowermost side 54 of the guide bracket 10 hitting the outer peripheral surface of the log 18 being trimmed/flattened/notched/cut.

The guide bracket 10 permits the chain saw 12 to be held in a transverse manner with respect to the longitudinal axis "L" of the log/timber being trimmed, while the saw tooth blades 32 and the elongated frame 26 are moved along the direction parallel to the longitudinal axis of the log 18 being cut as the chain saw 12 is held transversely with respect thereto. Thus, the sides of the saw teeth 32 as well as the peripheral portion thereof effect the cutting operation on the log 18. The positioning of the guide bracket 10 may be arranged to be spaced away from the log 18, as represented in FIG. 4, to initiate the cutting/notching operation. As such a kerf 14 or 16 is made, that bracket 10 may be re-set to a different or "blade-closer" position as represented in FIG. 2. It is to be noted that further embodiments include a second bracket 60, on the other side of the frame 26, represented in FIG. 4, for extra support on both sides of the blades 32 during any desired cutting operation.

Figure 7:
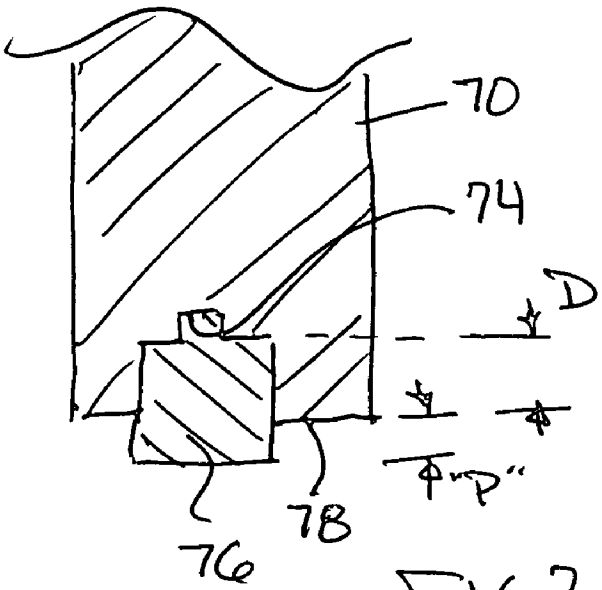
FIG. 7 is a cross-sectional view of a further embodiment of the elongated frame which supports the chain saw blade, absent a guide bracket.
Figure 6:
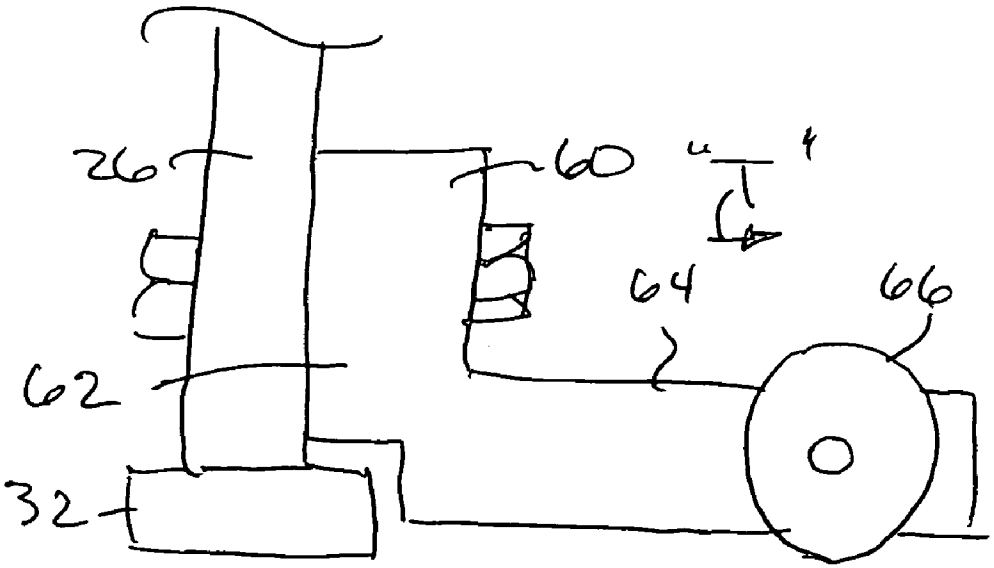
FIG. 6 is a cross sectional view of a further embodiment of the frame and guide bracket, with a roller wheel thereon.

A further embodiment of the elongated guide bracket 60 is shown in FIG. 6, which is shown in an "L" shaped cross-section thereat, with a first side member 62 and a second flange 64 attached about 90 degrees thereto, with at least one roller wheel 66 rotatably supported on an axis 68 on the second flange 64. The roller wheel 66 minimizes the frictional resistance as the saw 10 is moved in a transverse direction as indicated by the arrow "T" on the log/beam to make the kerf cut. FIG. 7 shows an elongated frame member 70 in a cross-sectional view with a peripherally-disposed link type saw blade 72 with blade exposure limited by the depth of the channel or blade supporting track 74 in which it rides. The teeth 76 have a limited protrusion "P" beyond the wide shoulders 78 of the frame member 70, at least one of those track or channel-defining shoulders 78 extending the width of the elongated frame member so as to allow the frame 70 itself to function as the guide bracket 10 disclosed in an earlier embodiment. The protrusion "P" of the chain saw blade 76 is preferably less that the depth "D" of the track or channel 74 in which that chain saw blade 76 rides.

Thus a saw tooth depth-limiting shoulder 78 of the elongated frame 70 itself, as represented in FIG. 7, or an adapter plate or bracket 10 attached to a typical elongated chain saw frame 26 is utilized to permit only a very limited "vertical" motion "M" of the saw teeth 32, as represented in FIG. 4. The primary motion of such a bracketed or shoulder-equipped chain saw 12 will be "back and forth", i.e. that is, "side-to-side", permitting a flattening of a log or the like without going too far through that log in an area where such flattening may be needed but where such a typically utilized sophisticated band saw or reciprocating saw may be unavailable.

The invention claimed is:

1. A chain saw arrangement for cutting flat sides on an elongated round log or timber having a longitudinal axis, comprising:

a chain saw housing at a first end of said chain saw;

an elongated chain/blade supporting frame extending from said chain saw housing;

a multi-tooth chain/blade movably supported in a peripheral track on the periphery of the elongated frame;

a substantially L-shaped support bracket having a first and a second side that extend parallel to the length of the chain saw, the first side adjustably mounted to the supporting frame and the second side extending, substantially perpendicularly from the first side;

a shoulder formed in the support bracket along the entire intersection of the first side and the second side that provides clearance for the movement of the multi-tooth chain/blade to move along the periphery of the elongated frame; and wherein the support bracket is vertically adjustable to control the depth of the blade teeth on the multi-tooth chain/blade extending out of the shoulder, beyond the second side of the support bracket and into the log or timber being worked and wherein the second side of the bracket provides support to the chain saw to permit sideways guided movement of the chain/blade along the longitudinal axis of the log or timber to cut flat sides into the log or timber.

2. The chain saw arrangement as recited in claim 1, wherein said first side of the bracket has a securement means therethrough for securing said bracket to said elongated frame.

3. The chain saw arrangement as recited in claim 2, wherein said first side of said bracket has a plurality of elongated slots therethrough to permit said securement means to alter the position-adjustment of said bracket.

4. The chain saw arrangement as recited in claim 1, wherein the shoulder is arranged at an outside corner of said sides to provide clearance to said teeth on said movable blade.

5. The chain saw arrangement as recited in claim 1, wherein said support bracket has a roller wheel rotatively supported thereon to minimize friction of said saw arrangement during transverse motion of a cutting operation therewith.

6. A chain saw arrangement for making a flat patch on a side of an elongated round log or timber, the log or timber having a longitudinal axis, comprising:

a chain saw housing at a first end of the chain saw;

an elongated chain/blade supporting frame extending from the chain saw housing;

a multi-tooth chain/blade movably supported in a peripheral track on the periphery of the elongated frame;

an "L"-shaped-in-cross-section support bracket comprising a first side and a second side generally perpendicular thereto, the first side secured in a position-adjustable manner, collinear with and attached along one side of the elongated frame, the L-shaped bracket having an elongated corner therealong at the junction of the first side and the second side, parallel to the elongated frame, the elongated corner having a blade tooth-depth-limiting relief-cut shoulder along its entire length, to control the depth of the blade teeth in the log, and to permit sideways guided movement of the chain/blade cutting of a log parallel to the longitudinal axis of the timber and for providing restricted support of said chain/blade on a log or timber during the timber-axis parallel cutting movement thereon; and wherein the support bracket is vertically adjustable to control the depth of the blade teeth on the multi-tooth chain/blade extending out of the shoulder, beyond the second side of the support bracket and into the log or timber being worked, and wherein the second side of the bracket provides support to the chain saw to permit sideways guided movement of the chain/blade along the longitudinal axis of the log or timber to cut flat sides into the log or timber.

7. The chain saw arrangement as recited in claim 6, wherein the blade of the chain extends from the peripheral track less than the depth of track in which the chain rides.

8. The chain saw arrangement as recited in claim 6, wherein the elongated frame extends beyond the length of the support bracket.

* * * * *